US005867128A

United States Patent [19]

Sauer

[11] Patent Number: 5,867,128

[45] Date of Patent: Feb. 2, 1999

[54] MULTICONTACT FOR ANTENNA WINDOW

[75] Inventor: Gerd Sauer, Stolberg, Germany

[73] Assignee: Saint Gobain Vitrage, Courbevoie, France

[21] Appl. No.: 723,228

[22] Filed: Sep. 27, 1996

[30] Foreign Application Priority Data

Sep. 28, 1995 [DE] Germany ..... 195 36 131.8

[51] Int. Cl.[6] ..... H01Q 1/32

[52] U.S. Cl. ..... 343/713; 343/906

[58] Field of Search ..... 343/713, 704, 343/829, 830, 906; 439/77, 83, 492, 493

[56] References Cited

U.S. PATENT DOCUMENTS

| | | | |
|---|---|---|---|
| 4,746,925 | 5/1988 | Toriyama | 343/713 |
| 4,815,981 | 3/1989 | Mizuno | 439/77 |
| 5,042,971 | 8/1991 | Ambrose | 439/77 |
| 5,363,114 | 11/1994 | Shoemaker | 343/713 |
| 5,632,646 | 5/1997 | Li et al. | 439/77 |

FOREIGN PATENT DOCUMENTS

| | | | |
|---|---|---|---|
| 0 392 969 | 10/1990 | European Pat. Off. . | |
| 0 612 119 | 8/1994 | European Pat. Off. . | |
| 44 06 240 | 8/1995 | Germany . | |
| 270387 | 10/1989 | Japan | 439/77 |

*Primary Examiner*—Don Wong
*Assistant Examiner*—Tan Ho
*Attorney, Agent, or Firm*—Oblon, Spivak, McClelland, Maier & Neustadt, P.C.

[57] ABSTRACT

A diversity reception antenna window provided with connection elements has connection lands of several antenna elements as well as shielding or grounding lines clustered at a location lying in the border area of the window locally in proximity to each other. Components (26) provided with connection plugs (40, 41), which at their base end have a flat support comprising junction lands (29, 33, 35, 31, 37, 39), which are arranged in accordance with the same layout as the corresponding connection lands on the window, are used as connection elements. The joining by soldering of the junction lands of the connection element with the connection lands on the window is performed in a single operation.

10 Claims, 2 Drawing Sheets

MULTICONTACT FOR ANTENNA WINDOW

BACKGROUND OF THE INVENTION

1. Field of the Invention

The present invention relates to a diversity reception antenna window for vehicles, provided with connection elements and in which connection elements provided with connection plugs at their free end are linked at their base section to the connection lands of the antenna conductors printed on the surface of the glass.

2. Description of the Related Art

Diversity reception antenna windows are antenna windows comprising several mutually independent antenna conductors. The individual antenna conductors are each provided with their own connection land and are each linked via a specific feed cable to the diversity processor. They are commonly used to improve radio reception in the FM band in vehicles. Because of the higher level of electrical interference in the region of the windscreen, they are preferably used as a rear window. As a general rule, in this case, the conductors of the heating system are also employed in the antenna system. Diversity reception antennae are already manufactured with up to ten different antenna elements. If the connections of the associated shielding lines are included with this, it means that up to twenty soldered joints need to be made.

Diversity reception antenna windows are described in a plurality of published documents, for example in DE 3 820 229 C1, DE 3 911 178 A1 and DE 4 034 548 A1, as well as EP-B1-0 065 263, EP-B1-0 269 723, EP-A1-0 559 196 and EP-A2-0 591 957. In most cases, the connection lands of each antenna element are arranged at different locations on the window, so that several connection elements need to be soldered at various locations. To avoid the drawbacks stemming from this, in particular when connecting the antenna window to the diversity processor, it is known from DE 3 911 178 A1 to cluster the antenna signal trunk lines on the window and to trunk all the antenna signals and, as appropriate, the supply voltages via a single cable bundle. Accordingly, the connection points of the various antenna elements are arranged near to one another.

In order to make the contact with the window, connection elements composed of flat lines are accordingly provided with multiple connection plugs, known in the art of computers. The conductors of this connection element which are linked to the multiple connection plug are traditionally manually linked one-by-one to the connection point, with each of them there being associated high-frequency lines and shielding lines.

SUMMARY OF THE INVENTION

An object of the invention is to improve and simplify the process for manufacturing diversity reception antenna windows comprising connection elements having multiple connection plugs, in such a way that the manual labor required to make the contact for the various antenna elements is substantially reduced.

This object is achieved in accordance with the invention by the fact that, on the window, the connection lands of several antenna elements as well as of any shielding or grounding lines are locally clustered side by side at a location lying in the border area of the window, that use is made of connection elements provided with multiple connection plugs have at their base end a flat support comprising junction lands, which are arranged according to a local layout corresponding to the local arrangement of the connection lands on the window, so that the joining of the junction lands with the connection lands can be carried out at the same time in one operation.

The window according to the invention can be implemented in principle with various constructions of conductors, for example with cable bundles composed of parallel coaxial cables which are kept together by a common insulating sleeve. Whereas the multiple connection plug is arranged at one end of such a cable bundle, at the other end is the flat support comprising the junction points, which are linked to the individual conductors of the cable bundle.

In a particularly advantageous embodiment of the invention, instead of cable bundles, flexible and flat conductive strips are used in which conductors are embedded in the strips and in which the junction points are made of a thin metallic layer or of a printed conductive composition and are arranged on the support strip. In the case of flat conductive strips, the signal trunk lines are also made of bands of metal strip or of conductive printed earths, which are applied to a support strip. Shielding lines can be arranged alongside these signal trunk lines. Similarly, it is possible to provide, in addition to the shielding lines arranged in the same plane or instead of these shielding lines, shielding strips which preferably extend over the whole width of the flat band conductor in another plane above and/or below the planes of the signal trunk conductors, so as to improve the shielding effect.

The joining of the connection element with the connection lands on the window may also be carried out differently, for example with the aid of an electrically conductive adhesive. If hot-activated or contact adhesives are used for this purpose, the adhesives are already applied in a suitable manner during the manufacture of the connection elements to the junction points of the support strip. After positioning the flat support on the window, the bonded junction may then be formed merely by pressure and/or heat.

Advantageously, the junction between the connection lands on the window and the junction points on the support strip is effected by means of a proven soldering process with a soft solder. In this case, during the manufacture of the connection elements, the junction points are suitably tinned and preferably already provided with flux, so that the soldering operation itself can be implemented without further addition of solder and/or flux, under the effect of heat and pressure.

In a further embodiment of the invention, the connection elements are bonded to the window over a predefined section, in such a way as to relieve the electrical junction points of injurious tensile forces, for example when plugging in after mounting the antenna windows into the body. These bonded junctions may be produced particularly easily and effectively with the flat conductive strips since the latter have a relatively large adhesive-coated surface. If the connection elements, for example in the vicinity of the junction points over the section of the support having the junction points, are previously covered with a thin layer of hot-activable adhesive, the electrical junctions with the connection lands of the antenna conductors and the tension-relieving bonded junction can be produced in a simple manner in a single operation.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The illustrated embodiments comprise heated rear windows for motor vehicles, wherein in each instance two separate heating systems are incorporated as antenna elements in the antenna construction. Furthermore, the two embodiments additionally have two other antenna elements which are arranged outside the heating systems. Of these additional antenna elements it is possible to see, in the partial views shown, only the end sections of the antenna conductors and the feed lines to the antenna conductors as well as the connection lands. The heater conductors, collector conductors which furnish the heater conductors with heating current, and the conductors of the additional antenna structures are all conventional printed and baked conductors.

Figure 1:
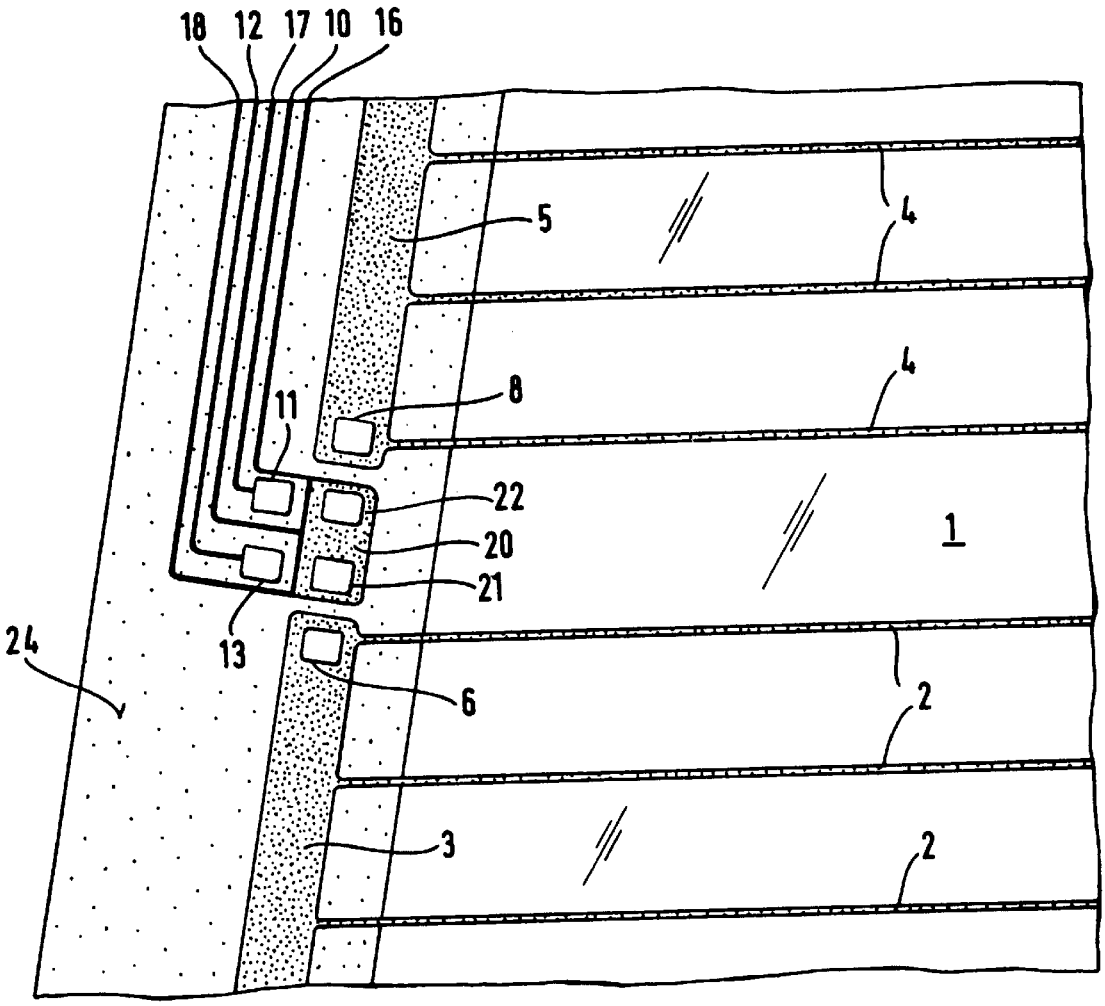
FIG. 1 is a partial view of a diversity reception antenna window in the region of the antenna conductors clustered with the connection lands for the connection element.

In the embodiment shown in FIG. 1, on the window 1, the heater conductors 2 forming the lower heating system are linked to the collector conductor 3, whereas the heater conductors 4 which form the upper heating system are linked to the collector conductor 5. The configuration of conductors made up of conductors 2 and 3 forms an antenna element, the antenna signals from which are tapped off from the collector conductor 3 at the connection land 6. The conductors 4 and 5 form the second antenna element. The signals received by this antenna element are tapped off from the collector conductor 5 at the connection land 8.

Two other antenna conductors, which are not illustrated as such, are arranged above the upper heating system. The supply line 10 of one of these antenna conductors extends as far as the connection land 11, and the supply line 12 of the other of these antenna conductors extends as far as the connection land 13. The two supply lines 10 and 12 are surrounded by shielding lines 16, 17 and 18 which are parallel to them and are linked to the conductive surface 20 printed between the collector conductors 3 and 5, which forms two connection lands 21 and 22.

The supply lines 10 and 12, the shielding lines 16, 17 and 18, the collector conductors 3 and 5, and the conductive surfaces 11, 13 and 20 forming the connection lands, are arranged on the window face turned towards the interior of the cabin in the lateral border region of the window, specifically in the region covered by the framelike trim 24, so that these conductors are not visible from outside the vehicle. The framelike trim 24 is made of a layer of opaque baked enamel which furthermore protects from UV rays the adhesive mass which fixes the window to the body. All the conductors are made of a curable ink containing metallic silver, suitable for soldering. The connection lands 6, 8, 11, 13, 21 and 22 can be covered with an additional tin layer combined with flux in order to facilitate the soldering procedure when soldering the connection elements.

Figure 2:
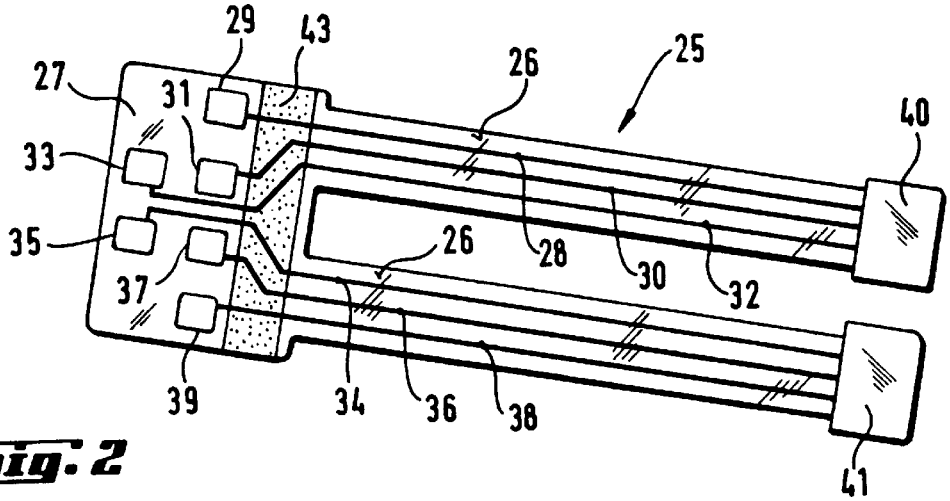
FIG. 2 shows a flat strip connection element to be associated with the antenna configuration shown in FIG. 1.

A connection element 25, suitable for this arrangement of the connection lands, is shown in FIG. 2. It comprises a flexible support strip 26 made of a thermostable and rupture-resistant polymer, for example a polyamide, with a base section 27, conductors 28, 30, 32, 34, 36 and 38 printed on the support strip 26 or embedded therein, junction lands 29, 31, 33, 35, 37 and 39 linked to these conductors, and multiple connection plugs 40 and 41 for connection to the cables in the body which extend to the diversity processor. On the support strip, the junction lands 29, 31, 33, 35, 37 and 39 are arranged in such a way that they will cover the corresponding connection lands 6, 21, 13, 11, 22 and 8. The junction lands 29, 31, 33, 35, 37 and 39 are surface-tinned and are provided with suitable flux. Alongside the junction lands, the support strip is covered with a thin layer of meltable adhesive in the surface region 43. The connection element 25 is positioned suitably on the border region of the window and is bonded to the glass surface by heat and pressure. At the same time, the electrical junction points are soldered together, the soldering operation being accelerated by the flux present on the layer of tin.

Figure 3:
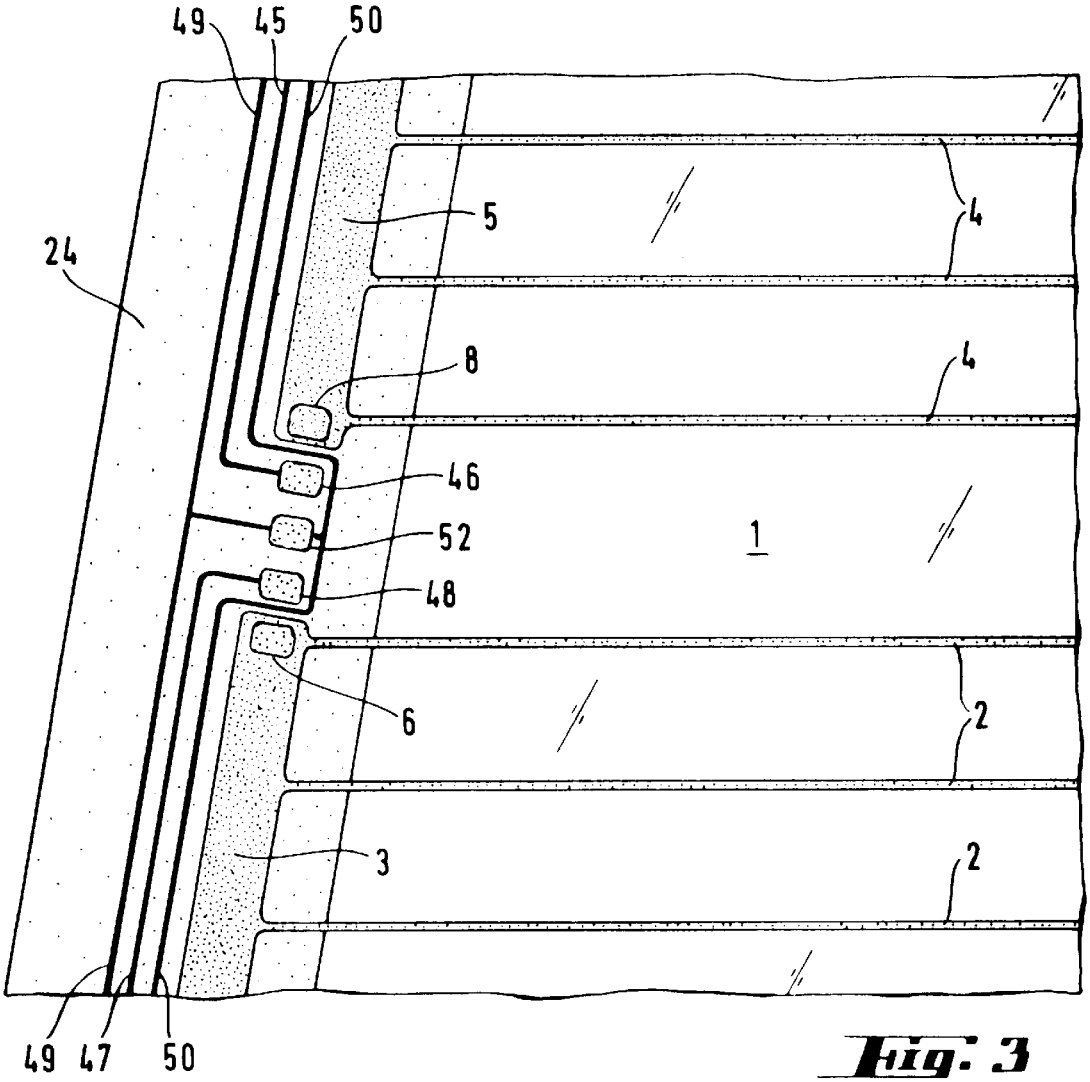
FIG. 3 is a partial view of another diversity reception antenna window, also in the region of the antenna conductors clustered with the connection lands.
Figure 4:
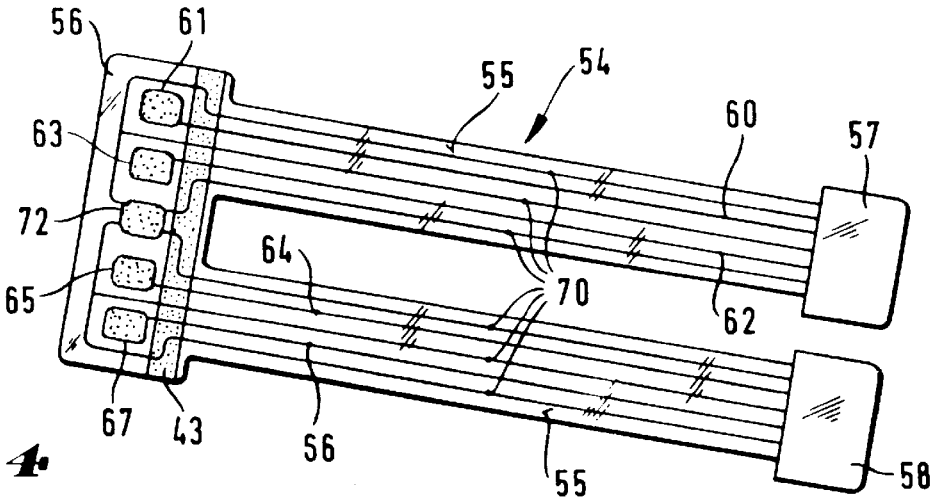
FIG. 4 shows a flat strip connection element to be associated with the antenna configuration shown in FIG. 3.

The embodiment shown in FIGS. 3 and 4 differs from the embodiment described hitherto in that an antenna element is arranged above the upper heating system, whereas another additional antenna element is arranged below the lower heating system. The line 45 departs from the upper antenna element and travels to the connection land 46, and the lower antenna element travels via the line 47 to the connection land 48. The two lines 45 and 47 are each protected by shielding lines 49 and 50 arranged on each side and which, for their part, end at the connection land 52. The antenna signals received by the antenna element composed of the conductors 2 and 3 are extracted from the collector line 3 at the connection land 6, and the signals received by the conductors 4 and 5 are extracted from the collector conductor 5 at the connection land 8.

The connection element is in principle constructed like the connection element 25 described earlier and comprises a flexible support strip 55 provided with a base section 56 and with multiple connection plugs 57 and 58. The four signal trunk lines 60, 62, 64 and 66 end at the junction lands 61, 63, 65 and 67. The signal trunk lines are surrounded on two sides by shielding conductors 70, all of which end at the common junction land 72 which is joined to the connection land 52 on the window. In this case also, a meltable adhesive layer 43 is applied to the base part 56 of the support strip alongside the junction lands, so that in this case also the bonded junction provides for the relief of tension at the soldered locations. The junction is produced in the same way as in the embodiment described earlier.

Obviously, numerous modifications and variations of the present invention are possible in light of the above teachings. It is therefore to be understood that the invention may be practiced otherwise than as specifically described herein.

What is claimed as new and desired to be secured by Letters Patent of the United States is:

1. A diversity reception antenna window for vehicles, comprising:

a window element;

antenna conductors having connection lands and printed on a surface of the window element;

shielding lines having connection lands and printed on the surface of the window element, wherein said connection lands of several of said antenna conductors and shielding lines are locally clustered side-by-side in a local arrangement at a border area of the window; and a connection element having plural connection plugs at a free end thereof and having a base section connected to said connection lands of said antenna conductors and said shielding lines, said base section including a flat support comprising junction lands arranged according to a local layout corresponding to the local arrangement of the connection lands of said antenna conductors and said shielding lines on the window, so that joining of all of the junction lands with the connection lands of said antenna conductors and said shielding lines can be carried out at one time and in one operation.

2. The window according to claim 1, wherein said connection element comprises flat-strip conductors with a support strip made from a tear-resistant polymer and conductors embedded in or printed on the support strip.

3. The window according to claim 2, wherein said support strip is made of a thermostable polymer.

4. The window according to claim 2, wherein said support strip is made of polyamide.

5. The window according to claim 2 wherein said flat-strip conductors further comprise flat shielding lines arranged in at least one of the plane of the signal trunk lines, a plane lying above the plane of the signal trunk lines and in a plane lying below the plane of the signal trunk lines.

6. The window according to claim 2 wherein the flat support strip of the connection element is bonded to the window in a region lying in proximity to the junction lands for relief of tension at the junction lands.

7. The window according to claim 2 wherein the flat support strip of the connection element is bonded to the window with a meltable adhesive in a region lying in proximity to the junction lands for relief of tension at the junction lands.

8. The window according to claim 1 wherein the junction lands of the connection element are soldered to the connection lands on the window.

9. The window according to claim 1 including a conductive adhesive joining the junction lands of the connection elements with the connection lands of the window.

10. The window according to claim 1 wherein all of said antenna conductors and shielding lines are locally clustered side by side in a local arrangement at a border area of the window.

* * * * *